United States Patent [19]

Miller

[11] 4,148,520

[45] Apr. 10, 1979

[54] PIECE OF FURNITURE

[76] Inventor: Ross M. Miller, 514 E. First St., Moscow, Id. 83843

[21] Appl. No.: 765,823

[22] Filed: Feb. 4, 1977

[51] Int. Cl.[2] ..... A47B 4/00

[52] U.S. Cl. ..... 297/16; 52/648; 297/441

[58] Field of Search ..... 297/16, 25, 45, 440, 297/441, 445, 449, 457; 52/648; 211/119.5, 119.01; 24/136 R

[56] References Cited

U.S. PATENT DOCUMENTS

| | | | |
|---|---|---|---|
| 166,022 | 7/1875 | Mihills | 24/136 R |
| 1,969,313 | 8/1934 | Meeker | 297/457 X |
| 2,399,070 | 4/1946 | Swanson | 211/119.01 |
| 3,169,611 | 2/1965 | Snelson | 52/648 |
| 3,206,037 | 9/1965 | Woolsey | 211/119.5 |
| 3,866,366 | 2/1975 | Fuller | 52/648 |
| 3,901,551 | 8/1975 | Wiesner | 297/16 X |

FOREIGN PATENT DOCUMENTS

| | | | |
|---|---|---|---|
| 389653 | 3/1922 | Fed. Rep. of Germany | 297/449 |
| 11379 of | 1913 | United Kingdom | 297/16 |

*Primary Examiner*—Roy D. Frazier
*Assistant Examiner*—Peter A. Aschenbrenner
*Attorney, Agent, or Firm*—Michael J. Striker

[57] ABSTRACT

A chair has four poles the ends of which are connected by cables or other tension-transmitting elements so that the poles are held in generally upright, spaced and mutually inclined positions. A textile or other flexible support is connected to the upper ends of the poles and when a weight rests on this support the cable becomes taut and the poles fixed in their positions.

7 Claims, 2 Drawing Figures

PIECE OF FURNITURE

BACKGROUND OF THE INVENTION

The present invention relates generally to a piece of furniture, and more particularly to a chair.

Specifically, the invention relates to tensile-integrity collapsible chair.

Collapsible chairs are known; however, no chair has thus far become known of the tensile-integrity type which I disclose herein.

SUMMARY OF THE INVENTION

Accordingly, it is an object of the present invention to provide a tensile-integrity piece of furniture, particularly a chair.

Another object is to provide such a piece of furniture which is lightweight and can be readily collapsed to form a relatively small bundle.

Still a further object is to provide such a piece of furniture which is inexpensive to construct and requires only a very small number of parts.

In keeping with these objects, and others which will become apparent hereafter, one feature of the invention resides in a chair which, briefly stated, comprises a plurality of columnar support members each having spaced upper and lower end portions; tensile means connecting the end portions of respective pairs of said columnar support members and maintaining the same in generally upright mutually inclined spaced positions; and means forming a support surface at least in the space bounded by the upper end portions, the tensile means becoming taut when a weight rests upon the support surface whereby the columnar support members become fixed in the positions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
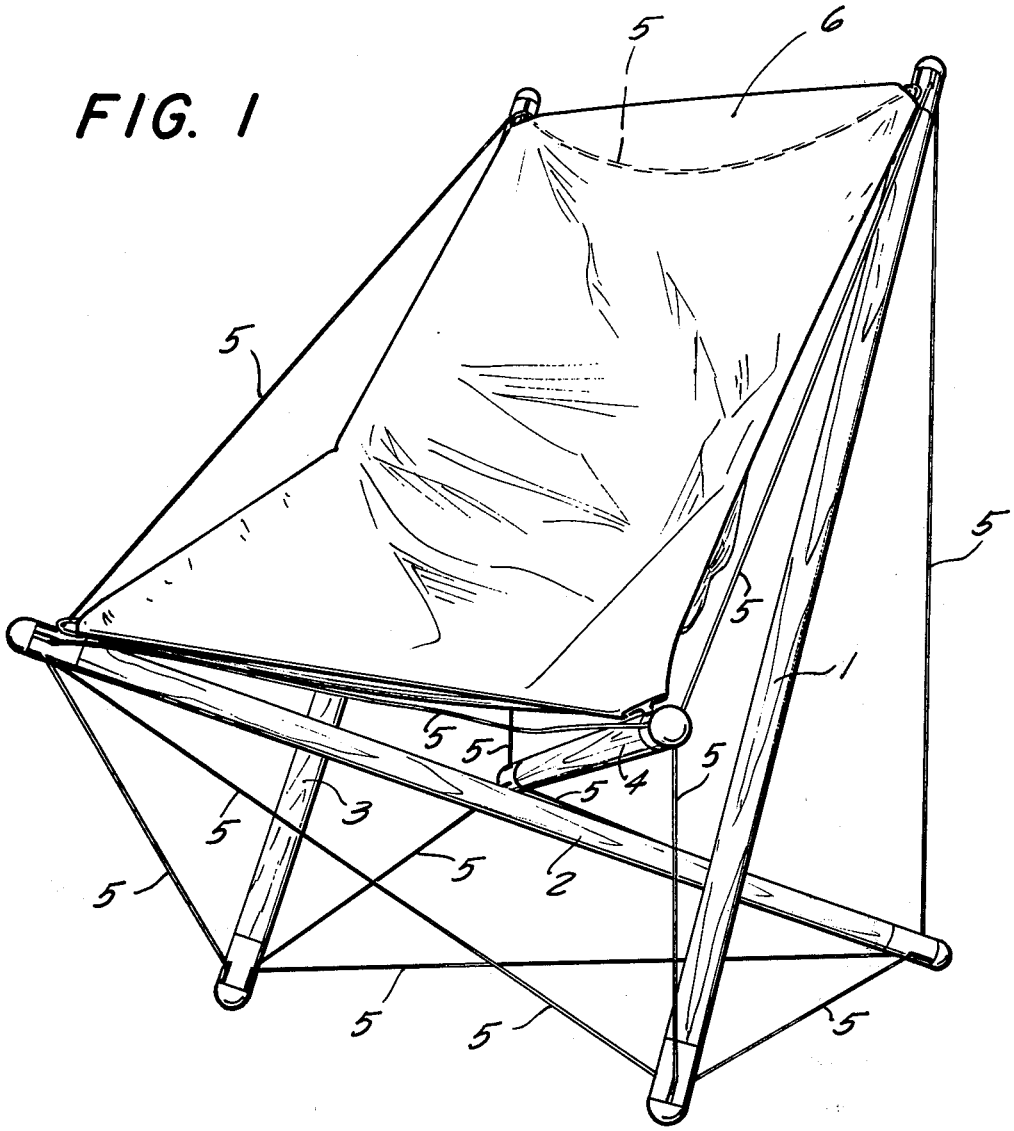
FIG. 1 is a perspective view of a chair embodying my invention.
Figure 2:
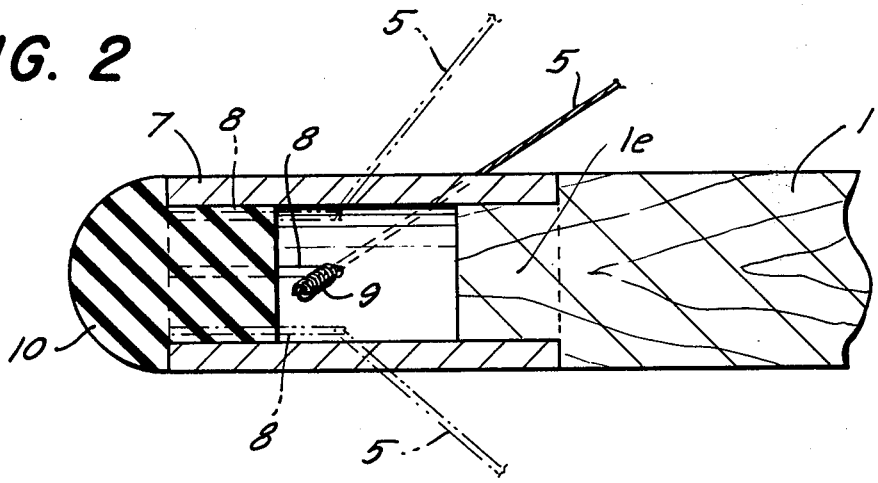
FIG. 2 is a fragmentary, sectional view showing a detail of the chair in FIG. 1.

The chair illustrated in FIGS. 1 and 2 has four columnar compression members 1, 2, 3 and 4, for example wooden poles although metal or any other suitably rigid material could also be used.

The members 1–4 are connected by tension-transmitting members which, for convenience, have all been designated with reference numeral 5. It should be noted that each member 5 connects respective end portions of at least two of the members 1–4, in such a manner that the members 1–4 assume the generally upright position shown in FIG. 1 and are held in the illustrated, mutually inclined spaced positions.

A support surface, e.g. a seat, is provided by a "sling", i.e., by a sheet of textile material, netting or any other suitably strong flexible sheet material 6 which is provided at its corners with hooks, loops or analogous devices by means of which the corners can each be fastened to one of the upper end portions of the respective members 1–4—or anywhere along the length of such members. The lower end portion of each member 1–4, respectively, of course, rests on the floor.

Tension members 5 may be textile or metal rope, chain, wire, straps of leather or fabric, or the like; I have found automobile brake cable to be especially suitable, both as to its flexibility and its tensile strength. The sheet material 6 may, of course, be supplemented by, e.g., padding. For example, the sheet material 6 could be in form of two layers between which padding material, e.g., plastic foam, is located. However, a separate layer of padding may also be placed on top of the sheet material 6 or beneath it.

One or more straps, or similar members (not shown), may be provided to extend between and connect the members 1 and 3 intermediate their ends. For example, members 1 and 3 may be provided with slots through which the straps may be drawn. The straps may be provided on the sheet material 6, e.g., by being sewn thereon.

Members 5 may, but need not be, connected to the end portions of members 1–4 in the manner illustrated in FIG. 2 with reference to the member 1.

The member 1 (and correspondingly all other members 2–4) may be provided at both ends (only one shown in FIG. 2) with a reduced-diameter portion 1*e*. A sleeve 7 of steel, other metal or other suitable material, may be pushed with a friction fit onto the portion 1*e*. Sleeve 7 is provided, at its end remote from member 1, with two or more (preferably three) axially extending slots 8. The tension members 5 are provided at their ends with enlargements 9 of any suitable kind (e.g., crimped-on, welded-on or otherwise secured knobs, buttons or the like). The ends of the respective members 5 are slipped through the slots 8 so that the enlargements 9 are located within the sleeve 7. Since the tension force always acts in a direction towards the inner blind ends of the slots 8, as is apparent from an inspection of FIG. 1, the enlargements (which are of course larger than the transverse dimension of the slots 8) cannot slip out of the slots. The hooks or analogous elements on the sheet material 6 could, if desired, be inserted into respective ones of the slots 8 so as to hold sheet material 6 in place.

For the sake of better appearance, and to cushion the chair and prevent injury to persons and damage to the floor and/or clothing, end plugs 10 of rubber or synthetic plastic material (or any other suitable material) may be inserted into the open ends of the sleeves 8 as shown.

Turnbuckles (not shown) might be incorporated in the members 5 if desired, but are not essential.

When a weight, such as the body of a user, is supported on the seat formed by sheet material 6, the members 5—which may normally be slack or be already stressed to some extent—become taut and transmit tensile forces between the members 1–4 which are thus fixed in their respective positions. However, by shifting the position of his body in the chair, a user can readily cause the structure to perform a swaying motion in all directions with a resulting soothing effect.

Of course, the members 5 can be connected to the members 1–4 in ways other than that illustrated. It is, however, desirable that the connection between the members 5 and the members 1–4 be releasable at least at one point, so as to permit the structure to be collapsed into a loose bundle for storage and/or transportation.

In place of the sheet material 6, a rigid molded shell, shaped panel or the like could be used to form the seat. Edge portions of the sheet material 6 or analogous element used in its place, could be employed in addition to—or in lieu of—some of the elements 5 for tension-transmitting purposes.

It will be understood that although each of the elements is described as embodied in a piece of furniture, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An erectable chair, comprising four columnar support members each having respective upper and lower end portions, a first pair of said four columnar support members being upright and extending parallel to one another in transversely spaced relationship, a second pair of said four columnar support members being inclined to the horizontal and crossing each other substantially midway between said upper and lower end portions thereof and intermediately said columnar support members of said first pair, each end portion of each of said support member being spaced from each end portion of each other one of said support members; means for forming a support surface at least between said upper end portions of said four columnar support members and being connected to said upper end portion of the support member of said first and said second pair respectively; and a plurality of tension members connecting the end portions of each of said columnar support members with the respective end portions of at least two other of said support members to maintain all of said support members in a desired position in which said support members of said first pair extending upright and parallel to each other and said support members of said second pair are inclined to the horizontal and cross each other substantially intermediate said support member of said first pair, said tension members being stressed to a tension-transmitting state when a weight rests upon said support surface of the erected chair whereby said columnar support members become fixed in said desired position.

2. A chair as defined in claim 1, wherein said columnar members are poles.

3. A chair as defined in claim 1, wherein said tensile means comprises elongated flexible rope-like elements.

4. A chair as defined in claim 3, wherein said tensile means comprises cables.

5. A chair as defined in claim 1, wherein said end portions each comprise a cap member and said tensile means are connected to the respective cap members.

6. A chair as defined in claim 5, wherein each cap member is seated with a friction fit on the associated end portion.

7. A chair as defined in claim 1, wherein said means forming said support surface comprises a flexible sheet member connected to the respective upper end portions.

* * * * *